252-99 AU 166 EX
6/27/78 XX 4,097,395

United States Patent [19]

Posey et al.

[11] 4,097,395

[45] Jun. 27, 1978

[54] MOLD AND MILDEW REMOVAL COMPOSITION AND METHOD OF MANUFACTURE

[75] Inventors: Dan E. Posey; Benjamin Mosier, both of Houston, Tex.

[73] Assignee: Chempro Corporation, Houston, Tex.

[21] Appl. No.: 759,747

[22] Filed: Jan. 17, 1977

Related U.S. Application Data

[63] Continuation-in-part of Ser. No. 720,986, Sep. 7, 1976, abandoned, which is a continuation of Ser. No. 388,660, Aug. 15, 1973, abandoned.

[51] Int. Cl.[2] ..... C11D 3/065; C11D 3/48

[52] U.S. Cl. ..... 252/106; 134/2; 134/3; 134/42; 252/99; 252/136; 252/142; 252/539; 252/540; 252/DIG. 14; 424/346

[58] Field of Search ..... 252/106, 99, 539, 540; 134/2; 424/346, 347

[56] References Cited

U.S. PATENT DOCUMENTS

| | | | |
|---|---|---|---|
| 3,002,883 | 10/1961 | Butt et al. | 424/347 |
| 3,063,895 | 11/1962 | Pearson et al. | 424/347 |
| 3,558,495 | 1/1971 | Mace | 252/90 |
| 3,824,190 | 7/1974 | Winicov et al. | 252/106 |

FOREIGN PATENT DOCUMENTS

| | | |
|---|---|---|
| 786,285 | 11/1957 | United Kingdom. |
| 1,096,869 | 12/1967 | United Kingdom. |
| 1,104,692 | 2/1968 | United Kingdom. |

OTHER PUBLICATIONS

"Typical Properties of Dowfax Diphenyl Oxide Sulfonates," Dow Chemical Co., Midland, Mich., Rec'd U.S.Pt.O. 10/15/71, pp. 3 & 4, (Sect. 3).

Hackett, "Germicidal Cleaners & Anti-Bacterial Cleaning," Detergent Age, Jan. 1968, pp. 84, 86 & 98.

*Primary Examiner*—P.E. Willis, Jr.
*Attorney, Agent, or Firm*—Kenway & Jenney

[57] ABSTRACT

A concentrate for producing a reactive mixture which mold and mildew cannot tolerate and which removes mold and mildew from a surface without scrubbing. The primary active ingredients of the concentrate consist essentially of acetic acid, sodium metasilicate, sodium tripolyphosphate, sodium alkyl benzene sulfonate, and sodium-o-phenylphenolate. A surfactant such as polyethoxylated nonyl phenol can be included to increase the solubility of the phenolate in aqueous solution.

An improved method of preparing the concentrate in a manner to prevent formation of silica gel includes adding the acetic acid last, and a three stage mixing procedure. The mold and mildew is removed by mixing the concentrate with water and bleach, and thereafter spraying the mixture onto an area to be treated.

12 Claims, No Drawings

MOLD AND MILDEW REMOVAL COMPOSITION AND METHOD OF MANUFACTURE

REFERENCE TO RELATED APPLICATIONS

This application is a continuation-in-part of application Ser. No. 720,986, filed Sept. 7, 1976, now abandoned, which was a continuation of application Ser. No. 388,660, filed Aug. 15, 1973, now abandoned.

The field of this invention is compositions which can be utilized to remove mold and mildew and methods for manufacturing and applying such compositions.

In many geographical regions of the United States, as well as in other countries, the unwanted growth of mold and mildew is an annoying problem. The rapid growth of mold and mildew on surfaces, such as house walls, is a particularly annoying problem for those who live in hot, humid geographical areas.

A costly problem occurs when mold and mildew is present on a surface that is to be painted. In order to properly paint or repaint a surface that has become infested with mold and mildew, it is necessary to completely remove the mold and mildew.

For the past several years, a concentrate has been available which when mixed with bleach (sodium hypochlorite) prior to application on a surface to be treated produces a reactive mixture which kills mold and mildew on a surface to which it is applied. A typical composition of a known prior art concentrate is given below in Table I.

Table I

Composition of Prior Art Concentrate

| Component | Concentration (in % by weight) |
|---|---|
| Water | 89.80 |
| Acetic acid | 4.25 |
| Sodium metasilicate | 0.70 |
| Sodium ethylenediamine-tetracetate | 0.35 |
| Linear alkyl benzene sulfonate sodium salt | 0.15 |
| Alkanolamide detergent | 0.15 |
| Linear alkoxy polyoxyalkalene ethanol | 0.35 |
| Sodium tripolyphosphate | 3.25 |
| Sodium-o-phenylphenolate | 1.00 |

A major disadvantage of the foregoing concentrate is that ingredients such as the alkanolamide detergent leave an unsightly film on the treated surface. Furthermore, the inclusion of constituents such as sodium ethylenediaminetetraacetate and linear alkoxy polyoxyalkalene ethanol increases the cost of producing the concentrate. In addition, with the foregoing concentrate, an unacceptable amount of sodium-o-phenylphenolate falls out of solution.

SUMMARY OF THE INVENTION

In accordance with the present invention, it has been discovered that the primary active ingredients necessary for an effective mold and mildew remover concentrate are acetic acid, sodium metasilicate, sodium tripolyphosphate, sodium alkyl benzene sulfonate and sodium-o-phenylphenolate and that sodium ethylenediaminetetraacetate, alkanolamide detergents and surfactants such as linear alkoxy polyoxyalkalene ethanol need not be included in a mold and mildew remover concentrate in order to produce a suitably reactive mixture.

It has also been discovered that the mixing order of the constituents in the concentrate is significant. In particular, in order to effect rapid dissolving of sodium metasilicate and sodium tripolyphosphate during the manufacture of the concentrate the other ingredients are solubilized in water, the polyphosphate and metasilicate are together solubilized in water, the two water solutions are mixed and agitated until all solids have dissolved, and thereafter the acetic acid is added.

Accordingly, it is an object of the present invention to provide a novel composition for removing mold and mildew from an infected surface.

A further object of the invention is to provide a new and improved mold and mildew remover concentrate of the type which is mixed with bleach prior to treating an infected surface.

Another object is to provide a method for removing mold and mildew from a surface which includes the step of spraying the novel mold and mildew remover onto an infected surface.

A further object is to provide an improved process for manufacturing a mold and mildew remover concentrate.

A further object of the invention is to provide a novel composition for a mold and mildew remover concentrate which does not contain an alkanolamide detergent.

Yet another object is to provide a mold and mildew remover concentrate which is more economical to manufacture than similar concentrates currently available.

Another object of the invention is to provide a concentrate which leaves no visible film on a treated surface and in most situations requires no scrubbing.

DESCRIPTION OF THE PREFERRED EMBODIMENTS

At the outset, the procedure for making the mold and mildew remover concentrate of the present invention is described in its broadest overall aspects with a more detailed description of the invention following.

The mold and mildew remover concentrate of the present invention is a reactive mixture of acetic acid, sodium metasilicate, sodium tripolyphosphate, sodium alkyl benzene sulfonate and sodium-o-phenylphenolate. When the concentrate is admixed with an oxidizing agent such as bleach and is sprayed on to an infected surface, the mixture not only removes mold and mildew without scrubbing, but also removes mold and mildew without leaving any noticeable residue on the treated surface.

At this point, it should be noted that bleach by itself is known to kill mold and mildew; however, when bleach is applied to a mildewed surface, although it kills mold and mildew, it does not remove the mold and mildew. Indeed, mold and mildew that has been killed with bleach is usually visible, and a discoloration usually appears on a mildewed surface treated with bleach.

The mold and mildew remover of the present invention, however, not only kills mold and mildew but removes it without abrasive scrubbing. Indeed, a major advantage of the mold and mildew remover of the present invention is that its use eliminates the need to hand scrub a surface. When the teachings of the present invention are followed, the oxidizing agent, such as bleach, not only kills the mold and mildew but also enables the remover to dissolve and remove it to produce a visibly clean surface.

In accordance with the present invention, the preferred organic acid for incorporation into the mold and mildew remover concentrate is acetic acid. Other aliphatic, as well as aromatic carboxylic acids, however, are useable in the present invention. By way of example, and not by way of limitation, carboxylic acids which may be included in the concentrate are formic, acetic, propionic, n-butyric and isobutyric. Citric acid and tartaric acid may also be employed as the organic acid ingredient in the concentrate. One fact influencing the choice of an organic acid is its water solubility, it being apparent to those skilled in this art that acetic acid is preferred because of its high solubility in water.

The concentrate is prepared by adding a quantity of water, the tripolyphosphate, and the metasilicate together in a first mixing vessel and agitating. To a second mixing vessel, a second quantity of water and the phenylphenolate are added and mixed for several minutes. Next, the surfactant, if one is used, is added and the solution is mixed until it becomes turbid. Lastly, the alkyl benzene sulfonate is added and mixed until the solution becomes clear.

As soon as the contents of the first mixing vessel are dissolved, the solutions in the two vessels are mixed together and stirring is continued until any remaining solids have dissolved. Lastly, the acetic acid is added to produce a stable, milky emulsion.

The foregoing method of manufacturing the concentrate is a result of numerous tests to optimize the compounding of the concentrate. As a result of these tests, it was found that in order to effect rapid solution of sodium metasilicate and sodium tripolyphosphate, the water temperature should preferably be close to boiling (180°-200° F), and the acetic acid and other ingredients should not be added until these materials are completely solubilized. Failure to take this latter precaution can result in the precipitation of silica gel in the concentrate which, once formed, is quite insoluble in either acid or basic media. The materials used in compounding the concentrate are described below, and may be purchased from the suppliers listed.

1. Water. The water used in the examples was dionized water. There is no significant differences in product effectiveness due to the use of municipal tap water, however, so long as the water does not contain abnormally high concentrations of dissolved alkali salts.

2. Sodium metasilicate. This material was obtained in reagent grade purity from Fisher Scientific Co., Houston, Texas. It may be obtained in commercial grades from Allied Chemical Corp., Diamond Shamrock Corp., and McKesson Chemical Co.

3. Sodium tripolyphosphate. This material was obtained in reagent grade purity from Fisher Scientific Co., Houston, Texas. It may be obtained in commercial grades from Allied Chemical Corp., McKesson Chemical Co., and Stauffer Chemical Co., Industrial Chemical Division.

4. Sodium alkyl benzene sulfonate. This material was prepared in the laboratory by reacting sodium hydroxide with Retzulfonic SD-12, which is a commercial grade linear alkyl sulfonic acid supplied by Witco Chemical, Organics Division.

5. Polyethoxylated nonyl phenol. This material is sold by Antara Chemical Co., under the tradename Igepal CO-887. It is a commercial grade surfactant comprising a 70% aqueous solution of polyethoxylated nonyl phenol having approximately 88% of its molecular weight made up by combined ethylene oxide.

6. Sodium-o-phenylphenolate. This material was obtained from Dow Chemical Co., as Dowicide A. It is also retailed by McKesson Chemical Co. The o-phenylphenol sodium salt used in sodium-o-phenylphenate tetrahydrate having the formula:

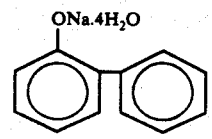

7. Acetic acid. This material was obtained in reagent grade purity from Fisher Scientific Co., Houston, Texas. It may be obtained in commercial grades from Allied Chemical Corp., Ashland Chemical Co., and McKesson Chemical Co.

In accordance with the foregoing method of preparation, several concentrates in accordance with the present invention were prepared and tested. The various constituents of the concentrate were added in amounts sufficient to yield a concentrate having the amount of constituents as set forth in Table II below.

Table II

| Component | Range in % by weight |
|---|---|
| Water | 93.30 -87.65 |
| Sodium metasilicate | 0.60 - 0.90 |
| Sodium tripolyphosphate | 2.50 - 3.50 |
| Sodium alkyl benzene sulfonate | 0.10 - .80 |
| Polyethoxylated nonyl phenol | 0 - 0.15 |
| Sodium-o-phenylphenolate | 0.50 - 1.50 |
| Acetic acid (glacial) | 2.00 - 5.50 |

Several examples were prepared having a composition within range set forth in Table II. As a result of testing, it was found that the pH of the concentrate is important. The pH was found to be important not only in determining the bacteriacidal efficiency of the product, but also the pH is a factor controlling the mutual solubility of the various components as a function of time. In order to determine the optimum pH of the final concentrate, several examples within the range set forth in Table I were prepared and titrated with acetic acid to yield a concentrate with pH values between 10.0 and 2.0. The composition of the two examples tested to determine optimum pH are set forth below.

| Component | Concentration in % by weight |
|---|---|
| Water | 90.70 |
| Acetic acid | 4.25 |
| Sodium metasilicate | 0.75 |
| Sodium tripolyphosphate | 3.00 |
| Sodium alkyl benzene sulfonate | 0.20 |
| Polyethoxylated nonyl phenol | 0.10 |
| Sodium-o-phenylphenolate | 1.00 |
| | 100.00% |

| Component | Concentration in % by weight |
|---|---|
| Water | 90.80 |
| Acetic acid | 4.25 |
| Sodium metasilicate | 0.75 |
| Sodium tripolyphosphate | 3.00 |
| Sodium alkyl benzene sulfonate | 0.20 |
| Polyethoxylated nonyl phenol | — |
| Sodium-o-phenylphenolate | 1.00 |

-continued

| Component | Concentration in % by weight |
|---|---|
| | 100.00% |

As is shown in Examples 1 and 2 above, Example 1 contained a surfactant whereas Example 2 did not.

The concentrate of Examples 1 and 2 were tested in actual field applications and were evaluated by comparing their effectiveness to that of the formulation set forth in Table I.

The results of these tests are set forth in Table III below.

Table III

| Testing Results | |
|---|---|
| Test Mixture Description | Relative Effectiveness |
| Example #1, pH = 2 | 1st |
| Example #1, pH = 7 | 4th |
| Example #1, pH = 10 | 6th |
| Example #2, pH = 3 | 5th |
| Example #2, pH = 6 | 2nd |
| Example #2, pH = 10 | 3rd |

For each example tested, the concentrate was found to be effective in removing mold and mildew. The reaction time required to obtain a clean surface, however, was found to be decreased by increasing the acetic acid concentration. It was also found that the purity of the sodium-o-phenylphenolate affects the reaction time. The higher the purity of the sodium-o-phenylphenolate, the faster is the reaction time. The surfactant was found to be desirable because it increases the solubility of the biocide in aqueous solution.

At this point, it should be noted that as the pH of Examples 1 and 2 were varied, so was the acetic acid concentration. Furthermore, the pH of Examples 1 and 2 can be varied by the addition of acids other than acetic acid.

Based upon the information derived from the tested as set forth above, optimum formulations were prepared. The concentrations of the components of two preferred concentrates are set forth in Examples 3 and 4 below.

| Component | Concentration % by weight |
|---|---|
| Water | 90.50 |
| Sodium metasilicate | 0.75 |
| Sodium tripolyphosphate | 3.00 |
| Sodium alkyl benzene sulfonate (50% active) | 0.40 |
| Polyethoxylated nonyl phenol | 0.10 |
| Sodium-o-phenylphenolate | 1.00 |
| Acetic acid (glacial) | 4.25 |

The pH of the concentrate set forth in Example 3 is about 2 of less. The concentrate set forth in Example 3 was tested and was found to perform extremely well on a wide variety of surfaces. It displayed cleaning effectiveness and short reaction times comparable to or exceeding the formulation set forth in Table 1.

EXAMPLE 4

The concentrate of this example is extremely effective in removing mold and mildew and contains no silica gel. The following ingredients and mixing procedure produces a stable milky emulsion having a density of about 8.69 lb/gal.

| Component | Concentration % by Weight |
|---|---|
| Water | 92.4 |
| Sodium metasilicate | 0.77 |
| Sodium tripolyphosphate | 3.0 |
| Sodium alkyl benzene sulfonate | 0.4 |
| Polyethoxylated nonyl phenol | 0.1 |
| Sodium-o-phenylphenolate | 0.5 |
| Acetic acid (glacial) | 2.6 |

To a first mixing vessel, 446.6 lbs. (53.5 gal.) water and 4.43 lb. of the phenylphenol were admixed and stirred for several minutes. To this solution, was then added 0.87 lb. Igepal surfactant and stirring was continued until the solution became turbid. Next, 3.56 lb. of sodium alkyl benzene sulfonate were added. The resulting solution was clear.

To a second container, 357.3 lb. (42.8 gal.) of water were mixed with 26.8 lb. sodium tripolyphosphate. After mixing, 6.69 lb. of sodium metasilicate were added and stirring continued.

As soon as the contents of the second container were dissolved, it was added to tank one. Stirring was continued until all solids were solubilized. Then, with continued vigorous stirring, a sufficient amount of acetic acid was added to reduce the pH to about 4.0 (from pH 11). This required approximately 23.2 lbs. or 2.65 gal. of acetic acid.

Based upon infarred studies, it was concluded that treatment of painted surfaces with proper concentrations of mildew remover and bleach in accordance with the present invention will not result in chemical or structural decomposition of typical paint resins (i.e., oil base alkyds, acrylics, vinyls, etc.). It was found, however, that excessive bleach concentrations can cause chemical degradation of binders, fillers, and/or inorganic pigments.

Temporary discoloration of painted surfaces appeared to be common with paints containing a vinyl or vinyl modified resin. This phenomenon may be due to the formation of a colored chlorine complex which results as chlorine gas is liberated by the bleach in solution. Such complexes are metastable, however, and decompose upon exposure to heat and light.

At this point, it should be noted that the concentrate set forth in the preceding two examples can be produced with lower production cost than is the case of the composition set forth in Table I.

To remove mold and mildew from a surface, a concentrate having a composition within the range as set forth in Table II is first mixed with water and an oxidizing agent such as bleach. As used through this specification and claims, the term bleach is intended to include ordinary household bleach. For best results, the bleach must contain a minimum of 5 percent sodium hypochlorite. In this regard, the quantities of bleach indicated herein are for bleach containing 5 percent by weight sodium hypochlorite. Of course, peroxides such as sodium peroxide and hydrogen peroxide and oxalic acid may also be employed as the oxidizing agent. In addition to the foregoing, chlorine tablets may also be employed as the oxidizing agent. Indeed, tests in accordance with the present invention were conducted with dry chlorine known as HTH dry chlorine tablets that were 70 percent active.

Due to concern regarding the warning statement accompanying the HTH dry chlorine product, several tests were conducted incorporating this material with aqueous solutions of mold and mildew remover concentrate to determine their chemical compatability. These tests were designed to accurately simulate the actual mixing orders that might occur during normal use of the products in question. The quantities of each product used to form the test mixtures were those recommended for normal use.

Three individual tests were performed corresponding to the three possible mixture orders, and each test is outlined as follows:

Test 1:

(a) Add 14.2 ml. of the concentrate of Example 3 to 227 ml. tap water and mix thoroughly.
(b) Add 3.39 g HTH (70 percent active) to the aqueous solution, and record temperature and off-gassing volume as a function of time.

Test 2:

(a) Add 3.39 g HTH (70 percent active ) to 227 ml. tap water and mix thoroughly.
(b) Add 14.2 ml. of the concentrate of Example 3 to the aqueous HTH solution, and record temperature and off-gassing volume as a function of time.

Test 3:

(a) Add 3.39 g HTH (70 percent active) to 14.2 ml. of the concentrate of Example 3 and mix thoroughly.
(b) Record temperature and off-gassing volume as a function of time.

Results of the tests are as follows:

| | TEST #1 | | TEST #2 | | TEST #3 | |
|---|---|---|---|---|---|---|
| Elapsed Time | Temp. | Gas Vol. | Temp. | Gas Vol. | Temp. | Gas Vol. |
| 0 minutes | 21.5 °C | 0 | 22.0 °C | 0 | 22.5° C | 0 |
| 1 minute | 21.5 °C | 0 | 22.0 °C | 0 | 40.5 °C | 200 cc |
| 3 minutes | 22.0 °C | 0 | 22.0 °C | 0 | 54.0 °C | 350 cc |
| 5 minutes | 22.0 °C | 0 | 22.0 °C | 0 | 63.0 °C | 480 cc |
| 10 minutes | 22.0 °C | 0 | 22.0 °C | 0 | 63.5 °C | 520 cc |
| 20 minutes | 22.0 °C | 0 | 22.0 °C | 0 | 59.0 °C | 540 cc |
| 40 minutes | 22.0 °C | 0 | 22.0 °C | 0 | 49.0 °C | 540 cc |

These results indicate that the mold and mildew remover concentrate should not be mixed directly with the specified quantity of the HTH dry chlorine. The concentrate contains a sufficient concentration of oxidizable material to produce a vigorous chemical reaction with 70 percent active HTH dry chlorine, resulting in the generation of large quantities of chlorine gas, accompanied by a significant increase in solution temperature. Although the mixture is not explosive and does not constitute a fire hazard, the chlorine gas which is liberated in copious amounts is quite toxic, especially in confined areas or those with poor ventilation. Also, such a reaction degrades components of the concentrate, thus imparing the effectiveness of the final solution.

The results of Tests 1 and 2 show that the concentrate or the HTH dry chlorine should be thoroughly premixed with the proper amount of tap water prior to being mixed together. Test 1 does indicate a slight temperature increase (0.5° C) and a yellow color was noted when the HTH dry chlorine was added to the aqueous solution. These phenomena are due to a slight reaction caused by a high localized HTH concentration in the immediate vicinity of the added HTH granules. This reaction ceases as soon as the HTH is thoroughly mixed.

A proper mixing order for the embodiment of the invention utilizing dry chlorine tablets is as follows:

(1) Add 8 oz. of 32 percent active dry chlorine to 2 gallons of tap water and mix thoroughly, and
(2) add one pint of the concentrate of Example 3 to the chlorine solution and mix thoroughly.

It is believed that the reason why the mold and mildew remover of the present invention is effective is that a chemical reaction takes place between the oxidizing agent and the other constituents in the concentrate which kills and removes the mold and mildew. Thus, it is necessary to add an oxidizing agent, such as bleach, to the concentrate immediately prior to treating a surface. It should be apparent to those skilled in this art that it is undesirable to store the oxidizing agent in the concentrate itself since doing so would result in a chemical reaction taking place during storage. The ratio of concentrate to bleach varies somewhat depending on the type of surface to be treated.

To treat either exterior wooden surfaces, exterior painted surfaces, metal surfaces, plastic surfaces, or vinyl surfaces, one pint of the concentrate having a composition as set forth in any of the examples is mixed with 3 pints of bleach in 2 gallons of water.

To treat stone, brick, stucco, or accoustical tile, 1½ pints of a concentrate is mixed with 2 quarts of bleach in 2 gallons of water.

For interior surfaces, such as painted walls and ceramic tile, the ratio of the concentrate to bleach to water is 1 to 3 to 26. If the mold and mildew remover is to be sprayed from a one-quart sprayer, the one-quart sprayer is loaded with 3 ounces of bleach, 26 ounces of water and 1 ounce of the concentrate. If interior walls are to be sprayed from a four gallon capacity sprayer, such a sprayer is advantageously loaded as follows: 3 gallons of water, 3 pints of bleach and 1 pint of concentrate.

Since a chemical reaction takes place between the bleach and the constituents of the concentrate, the speed of the chemical reaction is increased as the temperature of the system is increased. Thus, hot water can be utilized for faster results.

In any event, it is important that the remover be utilized immediately after mixing. In this regard, the reactive life of the mixture of bleach and concentrate is about three hours.

To apply the remover, it is convenient to utilize a garden sprayer that has been loaded with the correct proportion of bleach, water and concentrate. The ingredients may be mixed in the sprayer or mixed first in a separate container. In any event, the ingredients should be mixed to produce a fairly homogeneous system when in the sprayer. The mixture in the sprayer is then sprayed, preferably as a fine mist, over the mildewed area until the surface is moist. Successive coats of spray are applied until the surface is clean. When successive coats of spray are applied to a surface, it is desirable to wait at least five minutes between applications. When treating a surface to be painted or repainted, it is desirable to rinse the affected area after being treated.

The mold and mildew remover of the present invention is effective in removing mold and mildew which may be present on a variety of surfaces, such surfaces include stone, brick, stucco, exterior wood, exterior painted surfaces, tile, ceramics, accoustical materials, metal and plastic materials. The mold and mildew remover of the present invention has been found to be excellent for treating shower walls and boats.

The remover may be applied with a large variety of applicators, such applicators include garden sprayers, airless paint sprayers, compressor paint sprayers and hand sprayers.

At this point, it should be noted that many of the constituents of the concentrate are added as sodium salts. As is apparent to those skilled in this art, other alkali or alkaline metals may form such salts. For example, potassium metasilicate can be substituted on a mole basis for sodium metasilicate.

By following the teachings of the present invention, a mold and mildew remover concentrate results which is as effective as prior art concentrates, but which is less expensive to manufacture.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A concentrate which when added to water and an oxidizing agent produces a reactive mixture capable of killing and removing mold and mildew consisting essentially of the following constituents:

| Constituent | Range in % by weight |
|---|---|
| Water | 93.30 - 87.65 |
| Sodium metasilicate | 0.60 - 0.90 |
| Sodium tripolyphosphate | 2.50 - 3.50 |
| Sodium alkyl benzene sulfonate detergent | 0.10 - .80 |
| Polyethoxylated nonyl phenol | 0 - 0.15 |
| Sodium-o-phenylphenolate | 0.50 - 1.50 |
| Acetic acid (glacial) | 2.00 - 5.50 |

2. The concentrate as set forth in claim 1 wherein the concentrate consists essentially of the following constituents in the following concentrations:

| Constituent | Concentration in % by Weight |
|---|---|
| Water | 90.70 |
| Acetic acid | 4.25 |
| Sodium metasilicate | 0.75 |
| Sodium tripolyphosphate | 3.00 |
| Sodium alkyl benzene sulfonate detergent | 0.20 |
| Polyethoxylated nonyl phenol | 0.10 |
| Sodium-o-phenylphenolate | 1.00 |
| | 100.00% |

and wherein the pH of the concentrate is approximately 2.

3. The concentrate as set forth in claim 1 wherein the concentrate consists essentially of the following constituents in the following concentrations:

| Constituent | Concentration in % by weight |
|---|---|
| Sodium metasilicate | 0.75 |
| Sodium tripolyphosphate | 3.00 |
| Sodium alkyl benzene sulfonate detergent | 0.20 |
| Sodium-o-phenylphenolate | 1.00 |

the remainder of said concentrate consisting of water and a sufficient amount of acetic acid to make the pH of the concentrate approximately 6.

4. The concentrate as set forth in claim 1 wherein the concentrate consists essentially of the following constituents in the following concentration:

| Constituent | Concentration % by weight |
|---|---|
| Water | 90.50 |
| Sodium metasilicate | 0.75 |
| Sodium tripolyphosphate | 3.00 |
| Sodium alkyl benzene sulfonate detergent (50% active) | 0.40 |
| Polyethoxylated nonyl phenol | 0.10 |
| Sodium-o-phenylphenolate | 1.00 |
| Acetic acid (glacial). | 4.25 |

5. The concentrate as set forth in claim 1 wherein the concentrate consists essentially of the following constituents in the following concentrations:

| Constituent | Concentration % by weight |
|---|---|
| Sodium metasilicate | 0.77 |
| Sodium tripolyphosphate | 3.0 |
| Sodium alkyl benzene sulfonate detergent | 0.4 |
| Polyethoxylated nonyl phenol | 0.1 |
| Sodium-o-phenylphenolate | 0.5 |

the remainder of said concentrate consisting of water and a sufficient amount of acetic acid to make the pH of the concentrate approximately 4.0.

6. A method of preparing a concentrate which when added to water and an oxidizing agent produces a reactive mixture capable of killing and removing mold and mildew and which includes the following components in the following range in percent by weight:

| Constituent | Range in % by weight |
|---|---|
| Water | 93.30 - 87.65 |
| Sodium metasilicate | 0.60 - 0.90 |
| Sodium tripolyphosphate | 2.50 - 3.50 |
| Sodium alkyl benzene sulfonate detergent | 0.10 - .80 |
| Polyethoxylated nonyl phenol | 0 - 0.15 |
| Sodium-o-phenylphenolate | 0.50 - 1.50 |
| Acetic acid (glacial) | 2.00 - 5.50 |

wherein the method comprises adding the acetic acid after the other components have been placed in aqueous solution.

7. The method as set forth in claim 6 wherein the sodium metasilicate and sodium tripolyphosphate are added to the water while the water is at a temperature between 180°-200° F.

8. The method as set forth in claim 6 wherein the concentrate is prepared by:

(a) adding and solubilizing the metasilicate and tripolyphosphate in water in a first container;

(b) adding and solubilizing the other components in water in a second container;

(c) mixing the contents of said first and second containers; and (d) adding acetic acid to the mixed components.

9. The method as set forth in claim 8 wherein step (b) is effected by sequentially adding water, the phenylphenolate, and the detergent and step (a) is next effected by sequentially adding water, the tripolyphosphate, and the metasilicate.

10. The method as set forth in claim 9 wherein said polyethoxylated nonyl phenol is added between the addition of said phenylphenolate and said detergent.

11. A method of killing and removing mold and mildew comprising the following steps:

(a) mixing with water and an oxidizing agent selected from the group consisting of sodium hypochlorite, peroxides, oxalic acid, and chlorine a concentrate having the following composition:

| Component | Range in % by weight |
|---|---|
| Water | 93.30–87.65 |
| Sodium metasilicate | 0.60– 0.90 |
| Sodium tripolyphosphate | 2.50– 3.50 |
| Sodium alkyl benzene sulfonate detergent | 0.10– 0.80 |
| Polyethoxylated nonyl phenol | 0– 0.15 |
| Sodium- o - phenylphenolate | 0.50– 1.50 |
| Acetic acid (glacial) | 2.00– 5.50 |

and (b) spraying a surface to be treated with the mixture of Step (a) while said mixture is reactive.

12. The process as set forth in claim 11 wherein the concentrate has the following composition:

| Component | Concentration % by weight |
|---|---|
| Water | 90.70 |
| Sodium metasilicate | 0.75 |
| Sodium tripolyphosphate | 3.00 |
| Sodium alkyl benzene,Sulfonate-(50% active) detergent | 0.20 |
| Polyethoxylated nonyl phenol | 0.10 |
| Sodium -o- phenylphenolate | 1.00 |
| Acetic acid (glacial) | 4.25 |

* * * * *